US005823396A

United States Patent [19]

Vollmerhaus et al.

[11] Patent Number: 5,823,396

[45] Date of Patent: Oct. 20, 1998

[54] CHILD-RESISTANT LATCH FOR TRIGGER SPRAYER

[75] Inventors: Arno Vollmerhaus, Kierspe; Karl-Heinz Blauert, Iserlohn, both of Germany

[73] Assignee: Calmar-Albert GmbH, Hemer, Germany

[21] Appl. No.: 873,251

[22] Filed: Jun. 11, 1997

[30] Foreign Application Priority Data

Oct. 24, 1996 [EP] European Pat. Off. ..... 96117045

[51] Int. Cl.[6] ..... B67B 5/00

[52] U.S. Cl. ..... 222/153.13; 222/384

[58] Field of Search ..... 222/153.13, 384

[56] References Cited

U.S. PATENT DOCUMENTS 3,453,700 7/1969 Petertil et al. .
3,590,691 7/1971 Magers .
4,373,644 2/1983 Bennett .
4,441,633 4/1984 Bennett .
4,946,074 8/1990 Grogan .
5,114,049 5/1992 Knickerbocker .
5,207,359 5/1993 Steijns .
5,482,186 1/1996 Rodden, Jr. et al. ..... 222/153.14 X
5,564,604 10/1996 Tada ..... 222/153.14

*Primary Examiner*—Gregory L. Huson
*Attorney, Agent, or Firm*—Watson Cole Grindle Watson, P.L.L.C.

[57] ABSTRACT

A removable latch for use with a trigger actuated pump sprayer renders the sprayer child-resistant as the latch, of a one-piece plastic molded construction, is braced between a trigger actuator and an opposing portion of the pump body. The latch has an integrally molded spring biased clamp which engages the tongue of the trigger actuator provided for transmitting the manual pull force applied to the trigger to the pump piston. The latch has a spring-biased clamp engaging the tongue for removably securing the latch in place.

8 Claims, 1 Drawing Sheet

CHILD-RESISTANT LATCH FOR TRIGGER SPRAYER

BACKGROUND OF THE INVENTION

This invention relates generally to a child-resistant trigger sprayer, and more particularly to a removable latch which resiliently engages the trigger lever and prevents trigger actuation by acting as a brace against trigger pull.

As the use of trigger actuated pump sprayers become more widespread, the need arises to provide a simple and economical yet effective lock for immobilizing trigger actuation to render the dispensing package child-resistant especially when dispensing toxic liquids such as oven cleaners, and dispensing poisonous products such as insecticides.

Designs are known for locking the pump into an inoperative position, the unlocking requiring a two-step process incapable of being readily carried out by the child. Many of these child-resistant devices for trigger sprayers, however, require a retooling of one or more parts of the sprayer to accommodate the lock, which is capital intensive. Besides, the redesigned part or parts of the sprayer to accommodate the child-resistant lock could result in added assembly costs.

The need arises to provide a removable trigger lock which renders the trigger sprayer child-resistant by requiring at least two different unlocking operations.

SUMMARY OF THE INVENTION

The removable latch or trigger lock according to the invention has a body portion which extends between an underside of the trigger lever and a confronting portion of the pump body in abutting engagement with both so as to prevent trigger actuation. The latch has a spring-biased clamp molded integrally with the body portion and engages the tongue of the trigger lever, which tongue is provided for normally transmitting the manual trigger pull to the pump piston.

The body portion may be in the form of a flat plate having opposed bearing flanges abutting against the pump body and the underside of the trigger lever.

The spring biased clamp may be in the form of a pair of lever arms respectively located on opposite sides of the latch body portion, resilient bridge members interconnecting the arms with the body portion between opposite ends of the arms, and the lever arms defining opposing jaws on one side of the bridge members for engaging the tongue. The lever arms define opposing handles which when pressed together force the jaws to open.

The jaws may have detents at the free ends thereof for engaging the tongue of the lever, and the body portion of the clamp may have a projection extending into abutting engagement with an underside of the tongue for stabilizing the clamp when in place.

DETAILED DESCRIPTION OF THE INVENTION

Figure 1:
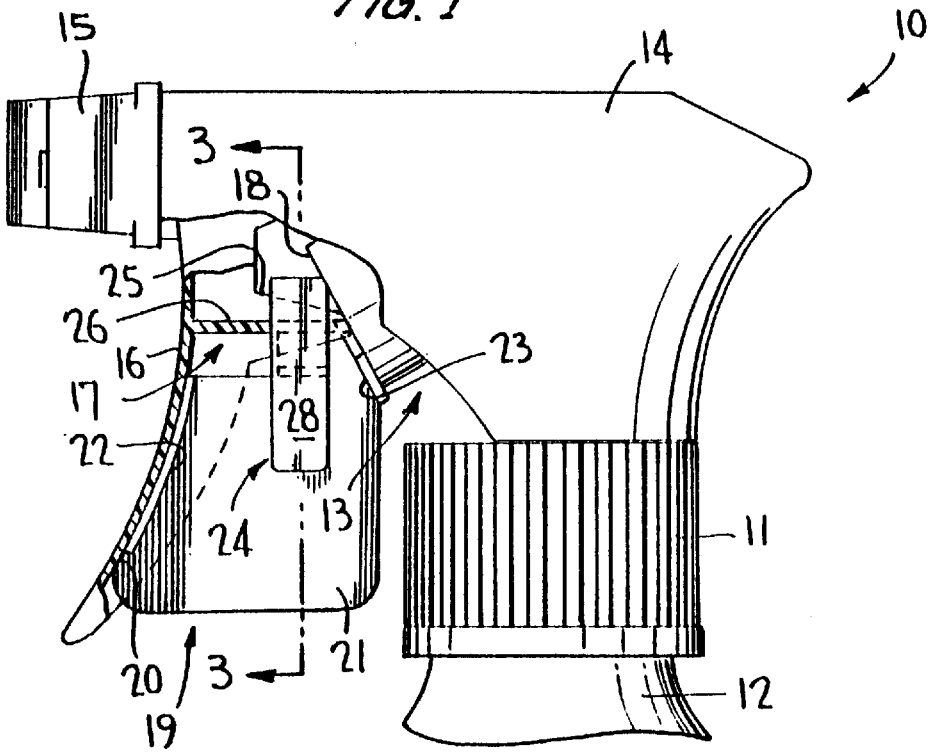
FIG. 1 is a side elevational view, partly in section, of a known trigger sprayer incorporating the present invention.

Turning now to the drawings wherein like reference characters refer to like and corresponding parts throughout the several views, a trigger actuated sprayer of known construction, generally designated 10 in FIG. 1, has a closure 11 for mounting the sprayer to the neck of a container 12 of the product to be sprayed. The trigger sprayer may be structured for operation essentially the same as that disclosed in U.S. Pat. No. 5,114,049, commonly owned herewith.

The sprayer includes a pump body 13 to which the closure is rotatably mounted, the pump body being surrounded by a shroud 14 and having a nozzle cap 15 rotatable about its nozzle end (not shown), the nozzle cap having a discharge orifice (not shown) through which liquid product is pumped from the container.

Pumping is effected by the provision of a trigger lever 16 pivotally mounted to the pump body in some normal manner, the lever having a tongue or tup 17 which engages the pump piston, more clearly shown in the aforementioned '049 patent, for reciprocating the same within pump cylinder 18 to therewith define a variable volume pump chamber (not shown).

Figure 2:
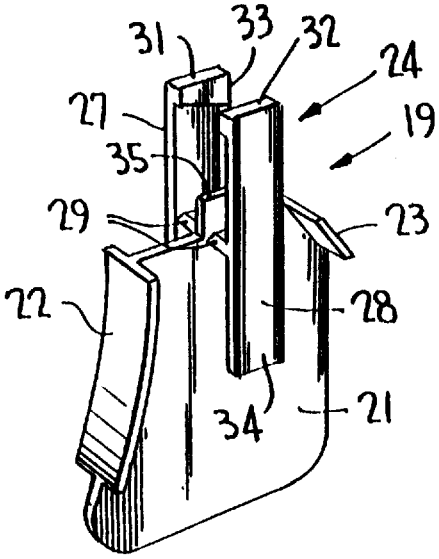
FIG. 2 is a perspective view of the latch means according to the invention.

The removable latch according to the invention, generally designated 19, is installed in place in FIG. 1 for locking the trigger lever against actuation and for rendering the sprayer child-resistant, and is shown in more detail in perspective in FIG. 2.

Latch 19 has a body portion 21 which may be in the form of a flat plate 21 of plastic molded unitary construction which, as shown in FIG. 1, extends between underside 20 of the trigger lever and a confronting portion of the pump body such as cylinder 18. Plate 21 has a forward flange 22 integrally molded therewith and complementary in shape with that of underside 20 of the lever. Plate 21 also has an integrally molded rear flange 23 complementary in slope to that of the end edge of pump cylinder 18. In the locked position of the trigger of FIG. 1, flanges 22 and 23 are in abutting engagement with the underside of the trigger lever and with the outer edge of the pump cylinder. The flanges may help to stabilize the latch while in place.

According to the invention, the latch is removably secured to tongue 17 by the provision of an integrally molded spring biased clamp 24.

It should be pointed out that tongue 17 is typically structured as having a pair of opposing triangular shaped side walls 25 and an intervening web 26. The tips of side walls 25 bear against the outer edge the pump piston, and the web 26 typically extends slightly into the hollow piston for stabilizing this abutting engagement.

The spring-biased clamp 24 may be in the form of a pair of lever arms 27, 28 respectively located on opposite sides of body portion 21, resilient bridge members 29 interconnecting the arms with portion 21 between opposite ends of the arms. The levers define opposing jaws 31, 32 which may have detents 33 at the free ends thereof for engaging tongue 17 at the upper edges of side walls 25 (see FIG. 3). The detents, as more clearly shown in FIG. 2, have sloping inner edges complementary to that of the sloping edges of side walls 25.

Furthermore, the lever arms define opposing handles 34 located on the side of the bridge members opposite the side at which the jaws are located.

Figure 3:
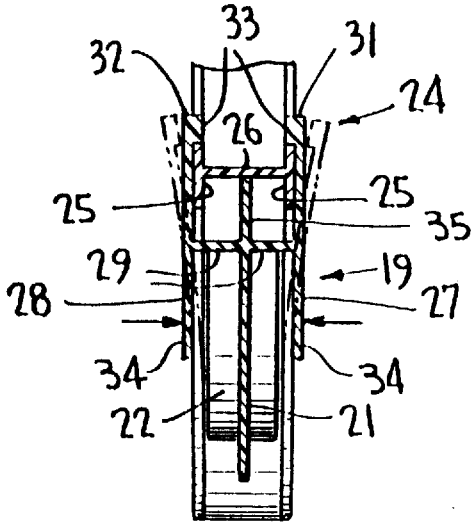
FIG. 3 is a sectional view taken substantially along the line 3—3 of FIG. 1.

Also, as shown in FIGS. 2 and 3, plate 21 has a projection 35 lying in the same plane and extending into abutting engagement with the underside of web 26 when the latch is assembled in place.

In the assembled condition, jaws 31, 32 resiliently engage side walls 25 of the tongue, while detents 33 engage the upper edges of side walls 25, and extension 35 abuts against the underside of web 26 of the tongue. And, flanges 22 and 23 respectively bear against the underside of the trigger lever and the outer edge of the pump cylinder, such that the latch according to the invention is stabilized when latched in place and functions to prevent trigger actuation.

To unlock the trigger, handles 34 are pressed together by applying a finger force in the direction of the arrows shown in FIG. 3. The resilient bridge members 29 act as fulcrums permitting jaws 31 and 32 to open by spreading apart, as shown in phantom outline in FIG. 3. Detents 33 of the jaws therefore disengage from side walls 25 of the tongue permitting latch 19 to be pulled downwardly away from the pump sprayer while continuing to apply inward finger pressure against handles 34.

The latch according to the invention is of plastic molded one-piece construction which is easy and economical to manufacture. And, the latch, being removable, is adaptable for use with a standard trigger sprayer without the need to redesign any parts thereof to accommodate the latch.

Obviously, many modifications and variations of the present invention are made possible in the light of the above teachings. It is therefore to be understood that within the scope of the appended claims the invention may be practiced otherwise than as specifically described.

What is claimed is:

1. Removable latch means for use with a trigger actuated pump sprayer for rendering the sprayer child-resistant, the sprayer having a pump body which includes a pump cylinder, a pump piston reciprocable within said cylinder for therewith defining a variable volume pump chamber, a trigger lever pivotally mounted on said pump body and having tongue means engageable with said piston for reciprocation thereof upon manual trigger, actuation, the latch means comprising a body portion of plastic molded unitary construction extending between an underside of said lever and a confronting portion of said pump body in abutting engagement therewith for preventing trigger actuation, said latch means having a spring biased clamp molded integrally with said body portion and engaging said tongue means for removably securing said latch means to the sprayer.

2. The latch means according to claim 1, wherein said body portion comprises a flat plate having opposed bearing flanges lying perpendicular to said plate in abutting engagement with said underside of said lever and with said confronting portion of said body when said latch means is secured to the sprayer.

3. The latch means according to claim 1, wherein said spring biased clamp comprises a pair of lever arms respectively on opposing sides of said body portion, resilient bridge members interconnecting said arms with said body portion between opposite ends of said arms, said levers defining opposing jaws on one side of said bridge members for engaging said tongue means, and said lever arms defining opposing handles on a side of said bridge members opposite said one side, said handles when pressed together forcing said jaws to open.

4. The latch means according to claim 2, wherein said spring biased clamp comprises a pair of lever arms respectively on opposing sides of said plate, resilient bridge members interconnecting said arms with said body portion between opposite ends of said arms, said levers defining opposing jaws on one side of said bridge members for engaging said tongue means, and said lever arms defining opposing handles on a side of said bridge members opposite said one side, said handles when pressed together forcing said jaws to open.

5. The latch means according to claim 4, wherein said lever arms lie substantially parallel to said plate, said bridge members extending perpendicular to said plate, and said jaws having detents for engaging the tongue means.

6. The latch means according to claim 1, wherein said clamp includes jaws on opposing sides of said body portion, said jaws having detents engaging said tongue means.

7. The latch means according to claim 6, wherein said clamp further includes handles integral with said jaws, said handles operating to open said jaws when pressed together.

8. The latch means according to claim 6, wherein said body portion has a projection extending into abutting engagement with an underside of said tongue means as said detents engage said tongue means.

* * * * *